United States Patent [19]

Lane et al.

[11] 4,372,637

[45] Feb. 8, 1983

[54] BOND SHIELD TERMINAL

[75] Inventors: David Lane, Greensboro; Mervin Woodward, Winston-Salem; Jerry B. Kilpatrick, Greensboro, all of N.C.

[73] Assignee: AMP Incorporated, Harrisburg, Pa.

[21] Appl. No.: 252,769

[22] Filed: Apr. 10, 1981

[51] Int. Cl.[3] ..... H01R 4/48

[52] U.S. Cl. ..... 339/244 R; 24/259 R; 174/87

[58] Field of Search ..... 339/47 R, 47 C, 241-244, 339/14 L, 14 R; 174/87; 24/219, 220, 259 R, 263 R

[56] References Cited

U.S. PATENT DOCUMENTS

| | | | |
|---|---|---|---|
| 3,838,387 | 9/1974 | Grillet | 339/244 UC |
| 4,186,986 | 2/1980 | Shoemaker | 339/114 |
| 4,340,996 | 7/1982 | Starace | 24/263 R |

*Primary Examiner*—Neil Abrams

[57] ABSTRACT

A bond shield terminal formed of two hermaphroditic elements of substantially identical shape, each element being lockable in the other and providing a force on a shield of a pair of wires positioned therebetween. Each of the hermaphroditic elements includes a base and a pair of latching arms depending from one adjacent pair of corners of the base, each of the latching arms having a pair of spaced apertures therein and a pair of legs depending from the other two corners of the base, each of the legs having a latching finger formed therein for locking into the apertures of the mating element. A pair of spring arms is formed in the base and depends therefrom in the same direction as the arms and legs, each of the spring arms having extensions for applying a force to wires between a pair of elements to provide a compressive force against the wires and maintain the metal shields thereof in compression against each other to provide good electrical contact.

18 Claims, 6 Drawing Figures

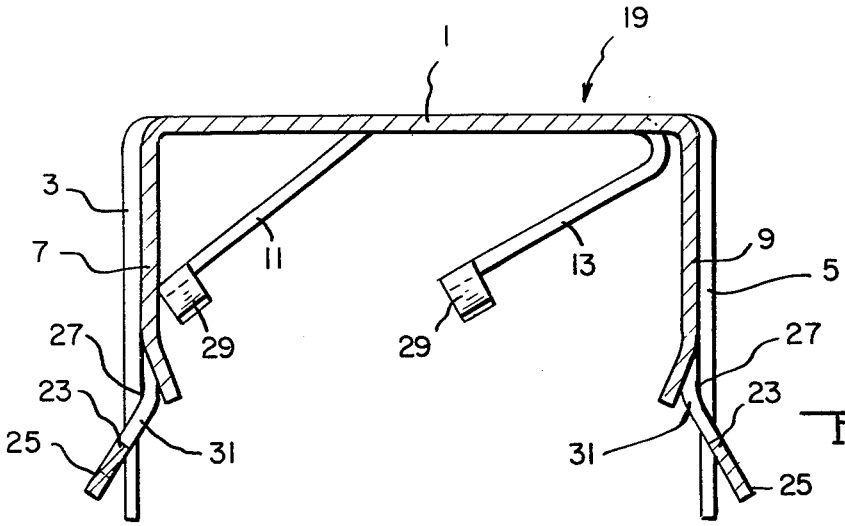
Fig. 3
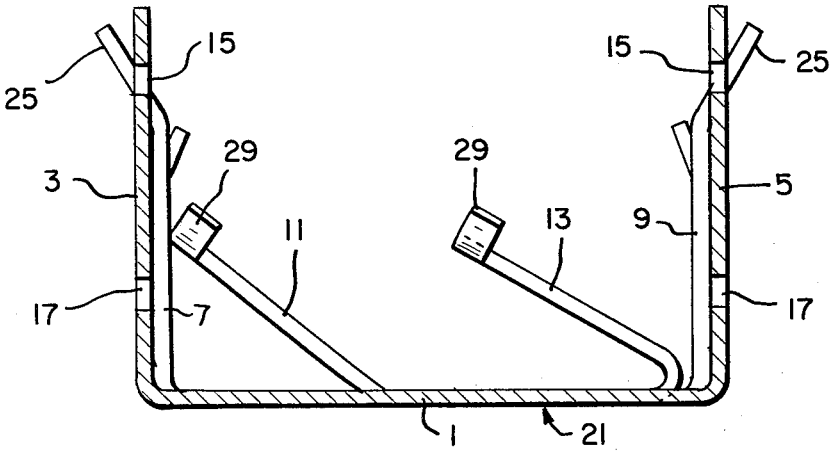
Fig. 4
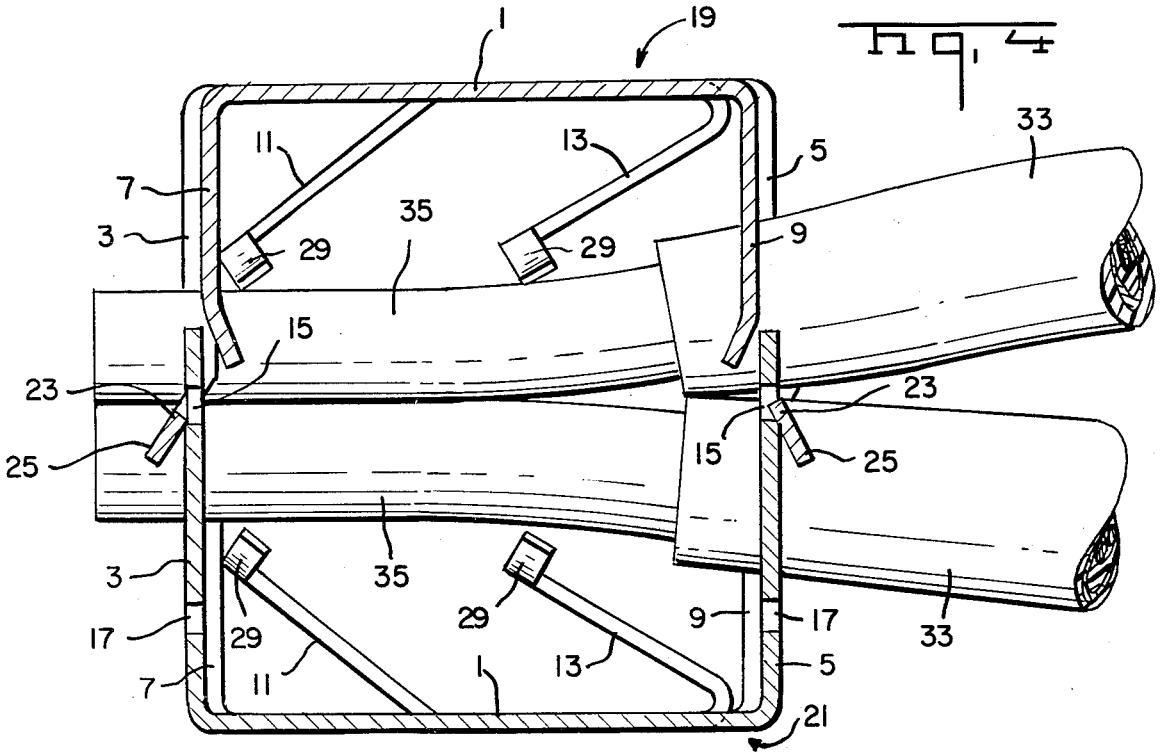

BOND SHIELD TERMINAL

BACKGROUND OF THE INVENTION

1. Field of the Invention

This invention relates to a bond shield terminal electrically interconnecting the metal shield jackets of a pair of spliced together electrical cables.

2. Description of the Prior Art

While underground wiring is aesthetically more desirable than overhead wiring and has come into greater use in recent years, such wiring is subject to moisture encountered in the underground environment. While the electrical cables themselves are substantially moisture proof, it is often necessary to form splices connecting lengths of cables and to shield the splices from the moist environment. This problem has been substantially resolved by the use of sealed splices as shown in the patent of Shoemaker (U.S. Pat. No. 4,186,986). It is however, necessary to provide a shell for the splices to be protected. The shell contains a volumetric collapsible container filled with a viscous sealing material. A closure cap is closed compressibly over the container, collapsing the container and expelling and distributing sealant throughout the connector shell. The shielding jackets of the spliced cable are electrically commoned by a terminal having a base plate, a further clamping plate and a screw to clamp and maintain the jacket in a common condition. Installation of this terminal requires a great deal of service time in the field and also suffers the problem that the foils are interconnected to only the terminal rather than in direct contact with each other. It is therefore desirable to provide a replacement terminal which can provide advantages both in the quality of interconnection as well as in the reliability and speed of installation thereof.

SUMMARY OF THE INVENTION

The above problems of the prior art are substantially lessened in accordance with the present bond shield terminal wherein two hermaphroditic elements of substantially identical shape are provided, each element being lockable in the other and providing a force on a shield of a pair of wires positioned therebetween.

Each of the hermaphroditic elements includes a base and a pair of latching arms depending from one adjacent pair of corners of the base, each of the latching arms having a pair of spaced apertures therein and a pair of legs depending from the other two corners of the base, each of the legs having a latching finger formed therein for locking into the apertures of the mating element. A pair of spring arms is formed in the base and depends therefrom in the same direction as the arms and legs, each of the spring arms having locking extensions for applying a force to wires between a pair of elements to provide a compressive force against the wires and maintain the metal shields thereof in compression against each other to provide good electrical contact.

In operation, a pair of hermaphroditic elements is disposed whereby the latching fingers of one element are positioned in the upper aperture of the latching arm of the mating element. A pair of wires with exposed metal shields in contact with each other is positioned between the two elements so that the spring arm of each element is positioned on or closely adjacent the shield of each wire. The elements are then forced together by a pliers or other tool whereby the latching fingers are moved out of the upper holes in the latching arms and locked into the lower holes thereof. In this condition, the spring arms will be forced back toward the base of their associated elements and apply a very large force against the metal shields to place the metal shield in compression against each other and possibly deform them. Due to the force applied by the spring arms against the wires, the elements will have forces thereon tending to move them apart, thereby causing the elements to be locked together by means of the latching fingers which are now under compression within the apertures. This bond will be secure due to the forces involved, the elements only being separable by applying a strong force whereby the latching fingers can be removed as is readily apparent.

BRIEF DESCRIPTION OF THE DRAWINGS

FIG. 3 is a cross-sectional view taken along the line 3—3 of FIG. 1 with partial engagement of the hermaphroditic elements;

FIG. 4 is a cross-sectional view as in FIG. 3 with the hermaphroditic elements in the open position and a pair of wires positioned within the terminal;

DESCRIPTION OF THE PREFERRED EMBODIMENT

Figure 1:
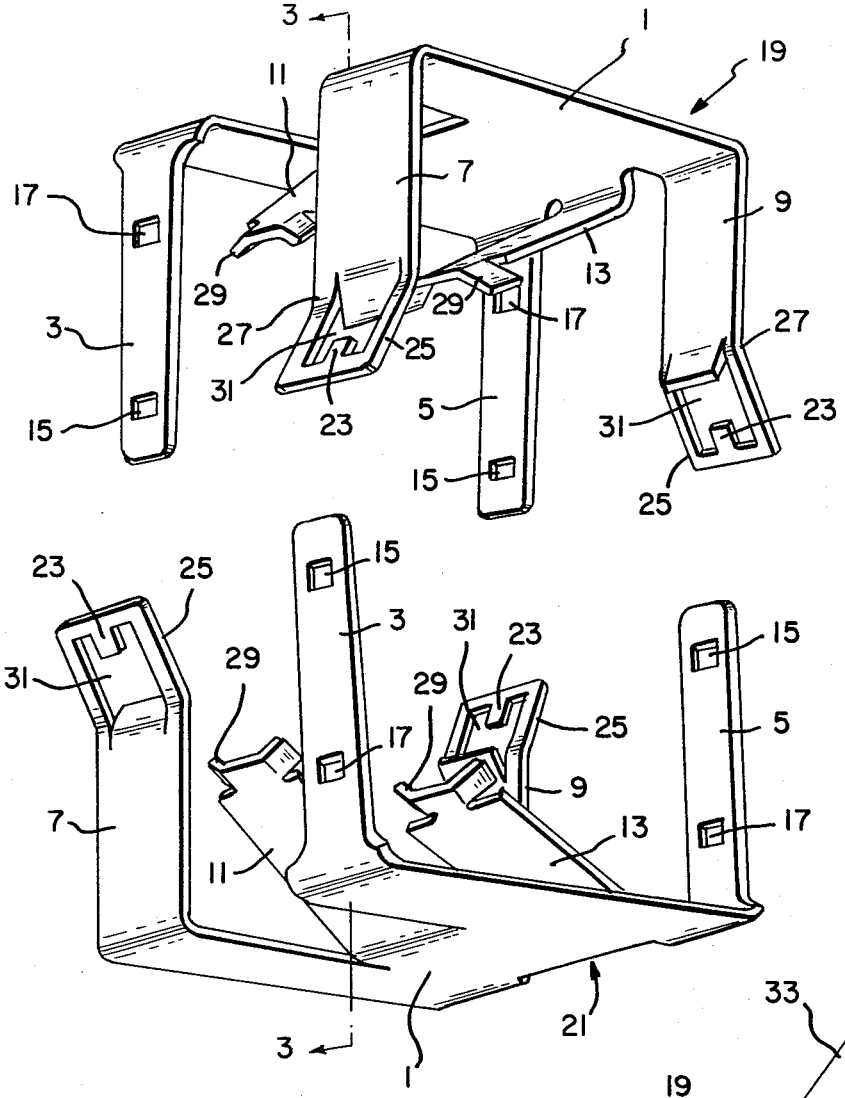
FIG. 1 is an exploded view of a pair of hermaphroditic elements which form the bond shield terminal in accordance with the present invention.
Figure 2:
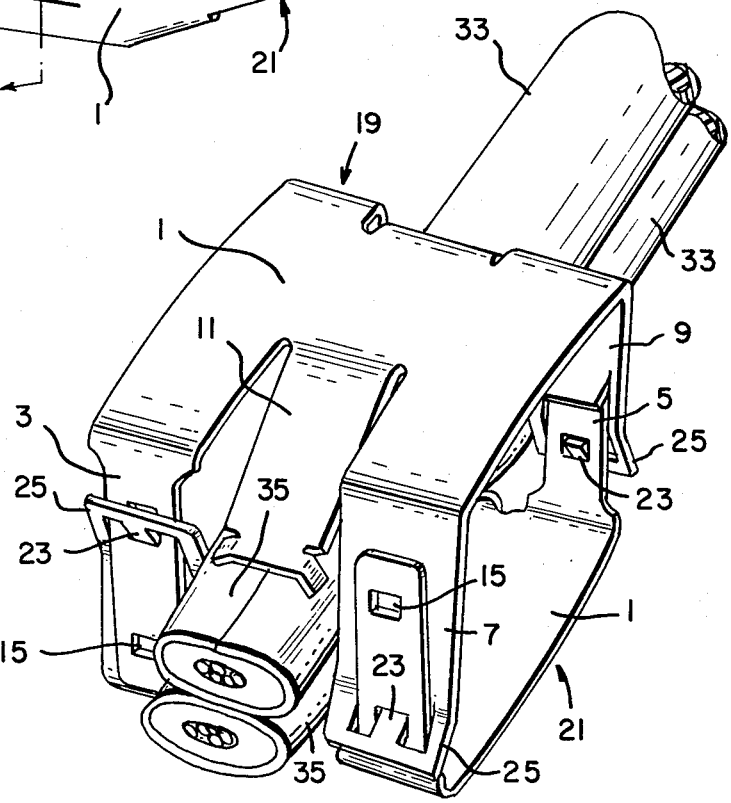
FIG. 2 is a perspective view of a pair of wires secured in the bond shield terminal of FIG. 1.
Figure 5:
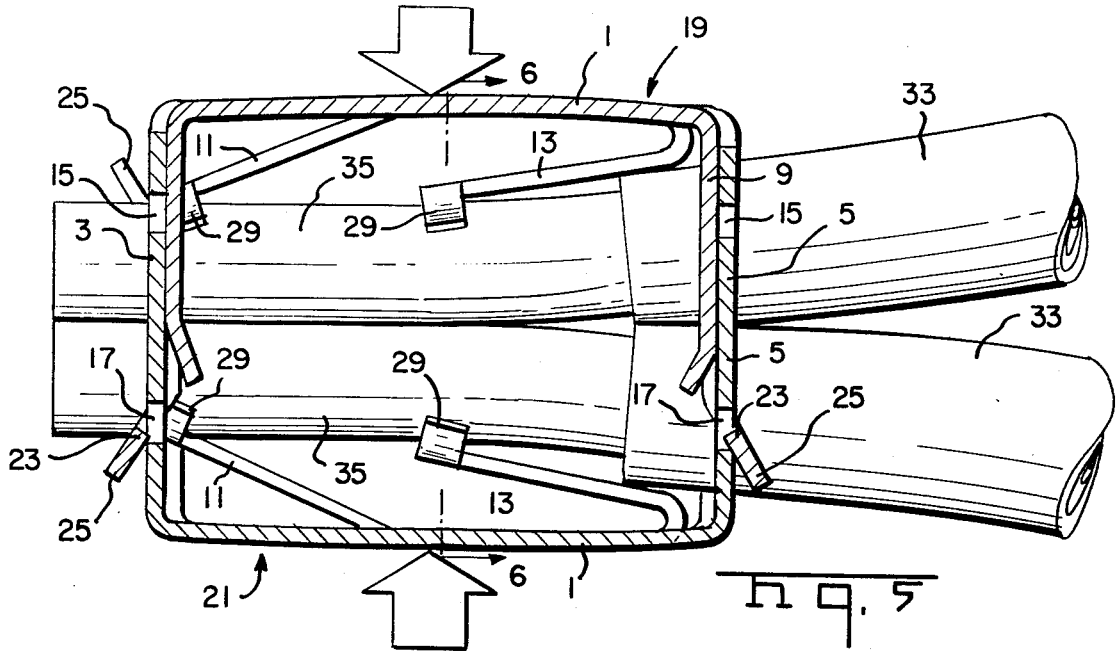
FIG. 5 is a view as in FIG. 4 after the hermaphroditic elements have been placed into the locking position.
Figure 6:
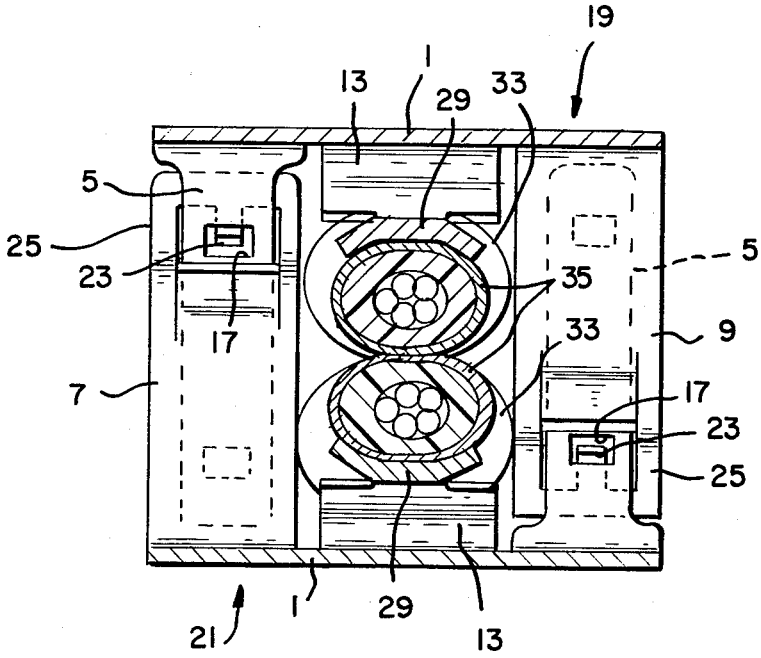
FIG. 6 is a view taken along the line 5—5 of FIG. 6.

Referring first to FIG. 1, there is shown an exploded view of a pair of identical hermaphroditic elements which form the bond shield terminal in accordance with the present invention. Each terminal includes a base portion 1 having a pair of depending latching arms 3 and 5 and a pair of depending legs 7 and 9. A pair of spring arms 11 and 13 depend from the base 1 in the same direction as the arms 3 and 5 and the legs 7 and 9. Each of the arms 3 and 5 includes a pair of lower apertures 15 and a pair of upper apertures 17, the lower apertures being utilized when the elements 19 and 21 are secured together in the unlocked position as shown in FIG. 3 and which will be described in more detail hereinbelow. The apertures 17 are utilized when the elements 19 and 21 are in the locked position as shown in FIGS. 2, 5 and 6 as will be described in more detail hereinbelow. Each of the legs 7 and 9 includes a latching finger 23 formed therein within an aperture 31 in a portion 25 which is bent at a slight angle at the bend point 27. The spring arms 11 and 13 are very rigid and include locking extension 29 thereon for pushing into the metal shield on the wires to be secured within the termina. The elements 19 and 21 can be stamped and formed out of metal into the shape as shown in FIG. 1 by conventional stamping and forming techniques utilized in metal working.

In operation in the field, the arms 3 and 5 will be directed through the apertures 31 in the legs 7 and 9 as shown in FIG. 3 and the elements 19 and 21 will continue to be moved together until the latching fingers 23 are positioned within the apertures 15 as shown in FIG. 4. At this time, a pair of wires 33 (FIG. 4) having exposed metal shields 35 will be placed together and forced between the elements 19 and 21. After the wires are positioned within the terminal as shown in FIG. 4, a force will be applied to each of the elements 19 and 21 as shown by the arrows in FIG. 5 whereby the element 19 and 21 will be moved closer together with the fingers 23 being removed from the apertures 15 and locking into the apertures 17. As can be seen with reference to FIGS. 2, 5 and 6, the spring arms 11 with locking extension 29 will be forced upwardly by the wires 33 toward the bases 1 of their respective elements 19 and 21. Since the spring elements 11 and 13 are very firm, they will apply a force against the wires 33 at the shield portions 35 to force the shield portions 35 to prevent the parts from slipping apart. As can be seen with reference to FIGS. 2 and 5, the force applied against the shield 35 is so great that the elements 19 and 21 have a tendency to be bowed at the base 1 rather than flat as is the case prior to final locking of the elements 19 and 21 together.

It is readily apparent that the elements 19 and 21 can be separated by applying a great force on the element bases 1 in the direction of the arrows in FIG. 5 whereby the latching fingers 23 can be removed from the apertures 17 and the elements then separated. However, when the elements 19 and 21 are secured as shown in FIGS. 2, 5 and 6, the force applied by the spring arms 11 and 13 tending to separate the elements 19 and 21 forces the latching fingers 23 against the walls of the apertures 17 to prevent separation of the elements.

Though the invention has been described with respect to a specific preferred embodiment thereof, many variations and modifications will immediately become apparent to those skiled in the art. It is therefore the intention that the appended claims be interpreted as broadly as possible in view of the prior art to include all such variations and modifications.

What is claimed is:

1. In a bond shield terminal formed from a pair of hermaphroditic interconnectable elements, each element comprising:

(a) a substantially flat base portion having four corner regions, (b) a pair of arms extending from adjacent ones of said corners normal to said base portion, each of said arms having aperture means formed therein, (c) a pair of legs extending from the other of said corners normal to said base portion, each of said legs having receiving means for receiving a said arm and latching means within said receiving means for entering a said aperture means in said received arm, and (d) spring arm means depending from said base portion in the direction of said arms and legs for securing a wire.

2. A bond shield terminal as set forth in claim 1 wherein said aperture means includes a pair of apertures spaced apart on said arm in a direction along a line normal to said base.

3. A bond shield terminal as set forth in claim 1 wherein said receiving means is an aperture formed in said leg.

4. A bond shield terminal as set forth in claim 2 wherein said receiving means is an aperture formed in said leg.

5. A bond shield terminal as set forth in claim 1 wherein said legs include a first portion extending from said base normal to said base and a second portion extending from said first portion at an obtuse angle thereto, said receiving means being an aperture in said second portion.

6. A bond shield terminal as set forth in claim 2 wherein said legs include a first portion extending from said base normal to said base and a second portion extending from said first portion at an obtuse angle thereto, said receiving means being an aperture in said second portion.

7. A bond shield terminal comprising:

(a) a pair of hermaphroditic interconnectable elements, each element comprising:

(b) a substantially flat base portion having four corner regions.

(c) a pair of arms extending from adjacent ones of said corners normal to said base portion, each of said arms having aperture means formed therein, (d) a pair of legs extending from the other of said corners normal to said base portion, each of said legs having receiving means for receiving a said arm and latching means within said receiving means for entering a said aperture means in said received arm, (e) spring arm means depending from said base portion in the direction of said arms and legs for securing a wire, and (f) the arms of one of said elements being disposed in the receiving means of the legs of the other of said elements, and the latching means on the legs of one of said elements being disposed in the aperture means on the arms of the other of said elements.

8. A bond shield terminal as set forth in claim 7 wherein said aperture means includes a pair of apertures spaced apart on said arm in a direction along a line normal to said base.

9. A bond shield terminal as set forth in claim 7 wherein said receiving means is an aperture formed in said leg.

10. A bond shield terminal as set forth in claim 8 wherein said receiving means is an aperture formed in said leg.

11. A bond shield terminal as set forth in claim 7 wherein said legs include a first portion extending from said base normal to said base and a second portion extending from said first portion at an obtuse angle thereto, said receiving means being an aperture in said second portion.

12. A bond shield terminal as set forth in claim 8 wherein said legs include a first portion extending from said base normal to said base and a second portion extending from said first portion at an obtuse angle thereto, said receiving means being an aperture in said second portion.

13. A bond shield terminal as set forth in claim 7 further including a pair of wires disposed between the spring arm means of each of said elements, said spring arm means applying a force on said wires to force said wires into mutual compression, said spring arm means applying a force to its associated base to force said base in a direction away from the other said base.

14. A bond shield terminal as set forth in claim 8 further including a pair of wires disposed between the spring arm means of each of said elements, said spring arm means applying a force on said wires to force said wires into mutual compression, said spring arm means applying a force to its associated base to force said base in a direction away from the other said base.

15. A bond shield terminal as set forth in claim 9 further including a pair of wires disposed between the spring arm means of each of said elements, said spring arm means applying a force on said wires to force said wires into mutual compression, said spring means applying a force to its associated base to force said base in a direction away from the other said base.

16. A bond shield terminal as set forth in claim 10 further including a pair of wires disposed between the spring arm means of each of said elements, said spring arm means applying a force on said wires to force said wires into mutual compression, said spring arm means applying a force to its associated base to force the base in a direction away from the other said base.

17. A bond shield terminal as set forth in claim 11 further including a pair of wires disposed between the spring arm means of each of said elements, said spring arm means applying a force on said wires to force said wires into mutual compression, said spring means applying a force to its associated base to force said base in a direction away from the other said base.

18. A bond shield terminal as set forth in claim 12 further including a pair of wires disposed between the spring arm means of each of said elements, said spring arm means applying a force on said wires to force said wires into mutual compression, said spring arm means applying a force to its associated base to force the base in a direction away from the other of said base.

* * * * *